US010288270B1

(12) United States Patent
Uahinui

(10) Patent No.: US 10,288,270 B1
(45) Date of Patent: May 14, 2019

(54) RELOCATABLE ILLUMINATORS

(71) Applicant: Toyota Motor Engineering & Manufacturing North America, Inc., Plano, TX (US)

(72) Inventor: Troy K. Uahinui, Burlington, KY (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 0 days.

(21) Appl. No.: 15/909,209

(22) Filed: Mar. 1, 2018

(51) Int. Cl.

| | |
|---|---|
| ***F21L 4/04*** | (2006.01) |
| ***F21S 9/03*** | (2006.01) |
| ***E01F 9/615*** | (2016.01) |
| ***F21V 21/06*** | (2006.01) |
| ***F21V 21/08*** | (2006.01) |

(52) U.S. Cl.
CPC ..... *F21V 21/0816* (2013.01); *F21L 4/04* (2013.01); *F21S 9/032* (2013.01); *F21V 21/06* (2013.01); *E01F 9/617* (2016.02)

(58) Field of Classification Search
CPC ..... F21V 21/06; F21V 21/0816; F21L 4/04; E01F 9/617; F21S 9/032
See application file for complete search history.

(56) References Cited

U.S. PATENT DOCUMENTS

| | | | | |
|---|---|---|---|---|
| 4,827,389 A | | 5/1989 | Crum | |
| 5,564,816 A | * | 10/1996 | Arcadia | A47G 33/02 362/121 |
| 6,082,880 A | * | 7/2000 | Nerlino | A47G 33/02 362/121 |
| 6,588,748 B2 | * | 7/2003 | Solow | A63H 33/00 273/146 |
| 8,029,154 B2 | | 10/2011 | Myer | |
| 9,115,856 B1 | | 8/2015 | Robinson | |
| 2014/0362564 A1 | | 12/2014 | Giblett | |
| 2016/0201885 A1 | | 7/2016 | Rood | |

FOREIGN PATENT DOCUMENTS

| | | |
|---|---|---|
| CN | 203760034 U | 8/2014 |
| TW | M503428 U | 6/2015 |
| WO | 2013139900 A1 | 9/2013 |

OTHER PUBLICATIONS

Solar Lighting Inc.; "Bluetooth Controlled—Portable Solar LED Overhead Light, Microphone & Speaker"; URL: http://www.solarlightinginc.com/portable-solarbluetooth-overheadlight.html; Nov. 21, 2017.

* cited by examiner

*Primary Examiner* — Thomas M Sember
(74) *Attorney, Agent, or Firm* — Dinsmore & Shohl LLP

(57) ABSTRACT

Embodiments described herein include a relocatable illuminator that includes an illumination component with a plurality of light emitting devices. The relocatable illuminator may include a solar collection device coupled to the plurality of light emitting devices and a base component that removably couples to a post by covering at least a portion of a top surface of the post. In some embodiments, the base component is configured to support the illumination component in a substantially vertical configuration to provide a lighted indication of a location of the post.

17 Claims, 3 Drawing Sheets

RELOCATABLE ILLUMINATORS

TECHNICAL FIELD

Embodiments described herein generally relate to relocatable illuminators and, more specifically, to embodiments for illuminating a bollard or type of post.

BACKGROUND

Parking lot posts and bollards may be utilized along parking lot perimeters and/or elsewhere to prevent vehicles from entering or exiting a predefined area. These parking lot posts and bollards can be difficult to see for a vehicle driver or pedestrian, especially in the dark, thus increasing the risk that a vehicle may collide with the post. As such, a need exists in the industry for a mechanism to increase the visibility of these parking lot posts and bollards.

SUMMARY

Embodiments described herein include a relocatable illuminator that includes an illumination component that includes a plurality of light emitting devices. The relocatable illuminator may include a solar collection device coupled to the plurality of light emitting devices and a base component that removably couples to a post by covering at least a portion of a top surface of the post. In some embodiments, the base component is configured to support the illumination component in a substantially vertical configuration to provide a lighted indication of a location of the post.

In another embodiment, a system may include a post and a relocatable illuminator that provides a lighted indication of a location of the post. The relocatable illuminator may include an illumination component that includes linearly displaced light emitting devices and a solar collection device coupled to the linearly displaced light emitting devices. The relocatable illuminator may additionally include a base component that securely couples to the post by entirely covering a top surface of the post. The base component may be configured to removably secure the relocatable illuminator to the post and support the illumination component in a substantially vertical configuration.

Another embodiment for illuminating may include a post and a relocatable illuminator. The relocatable illuminator may include an illumination component that provides a lighted indication of a location of the post and includes at least one light emitting device and a solar collection device coupled to the light emitting device. The relocatable illuminator may additionally include a base component that securely couples to the post by covering at least a top surface of the post and at least a portion of a sidewall of the post. The base component may be configured to support the illumination component in a substantially vertical configuration.

These and additional features provided by the embodiments of the present disclosure will be more fully understood in view of the following detailed description, in conjunction with the drawings.

BRIEF DESCRIPTION OF THE DRAWINGS

The embodiments set forth in the drawings are illustrative and exemplary in nature and not intended to limit the disclosure. The following detailed description of the illustrative embodiments can be understood when read in conjunction with the following drawings, where like structure is indicated with like reference numerals and in which.

DETAILED DESCRIPTION

Embodiments disclosed herein include relocatable illuminators. Some embodiments of a relocatable illuminator may include a plurality of light emitting devices, configured as a light whip, rod, or the like. Some embodiments may be constructed of polycarbonate or other similar material and thus may be less likely than an acrylic composition to break when struck. Embodiments may include a plurality of linearly displaced light emitting devices (such as light emitting diodes) that may be inserted into an illumination component and connected to a battery set or other power supply. These batteries may be charged via a solar collection device (which may include solar photovoltaic cells) and a photo eye sensor for providing energy to the plurality of light emitting devices. The solar cells may be removably or permanently coupled to the base component.

The illumination component may be configured as a light rod and can be attached to a bollard or other type of post in a plurality of different ways. One embodiment utilizes a flat base component with a rare earth magnet and a connection portion that is coupled to the illumination component. In these embodiments, the flat base component is coupled to a top surface and/or top portion of a post (such as a metal post or a post with a metal or magnetic attachment) and the connection portion may removably connect to the base component.

In some embodiments, the base component may be configured as a cap base component of the appropriate diameter that would fit over a top portion of the post. Some embodiments may utilize a strap base component that includes a plurality of integrated straps that are draped over the top of the post and secured with zip ties or other securing mechanism. The embodiments of a relocatable illuminator incorporating the same will be described in more detail, below.

Figure 1:
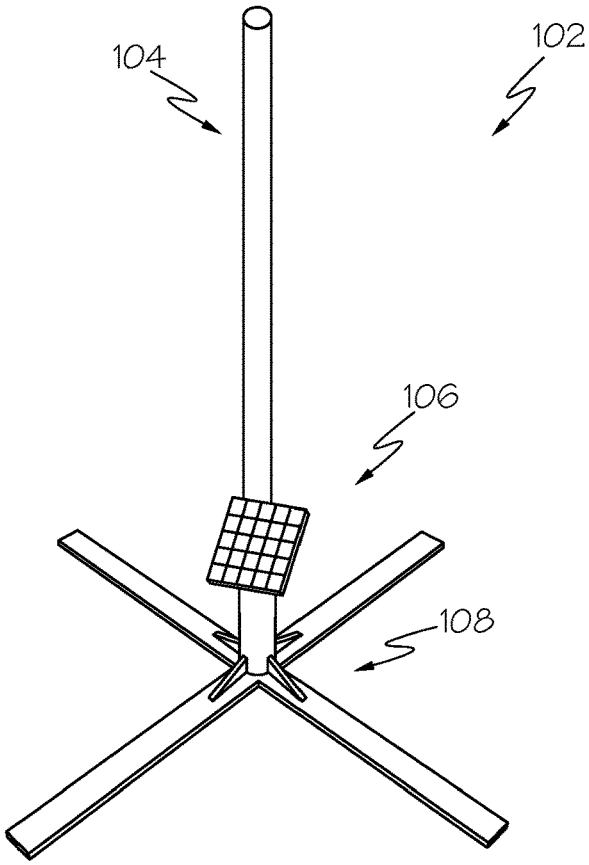
FIG. 1 depicts a relocatable illuminator, according to embodiments described herein.

Referring now to the drawings, FIG. 1 depicts a relocatable illuminator 102, according to embodiments described herein. As illustrated, the relocatable illuminator 102 includes an illumination component 104, a power component 106, and a base component 108. The illumination component 104 may be disposed in a substantially vertical configuration and may be configured as a tube, rod or other receptacle for receiving one or more illumination devices, such as a string or plurality of light emitting diodes, light bulbs, and/or other devices that are capable of emitting light. While in some embodiments, the emitted light is provided as one or more colors in the visible spectrum, some embodiments are configured to emit light in the infrared or other invisible spectrum such that a vehicle sensor may detect the presence of the relocatable illuminator 102, regardless of whether a vehicle driver can see the illumination devices. Additionally, some embodiments may be configured to permanently house the one or more illumination device.

Some embodiments may be configured to removably house the one or more illumination device.

Also provided is the power component 106. The power component 106 may be electrically coupled to the illumination component 104 and may be configured to provide energy to the illumination devices. As such, the power component 106 may include a battery and/or a power supply. The power supply may be configured as a photovoltaic cell or other solar panel, and/or may include an electric plug. In some embodiments, the battery may be replaceable and/or rechargeable such that the solar panel is not utilized.

Also provided in FIG. 1 is the base component 108. As described in more detail below, the base component 108 may be configured to couple with a post to provide a lighted indication of a location of the post. As such, embodiments described herein may be configured to couple with a top portion of the post. The coupling of the post and the relocatable illuminator 102 may be permanent in some embodiments or removable in other embodiments.

While the base component 108 of FIG. 1 is depicted as strap base component, this is merely an example. As discussed in more detail below, the base component 108 may take any configuration described herein, such as a flat base component, a cap base component, and/or a strap base component.

Figure 2A:
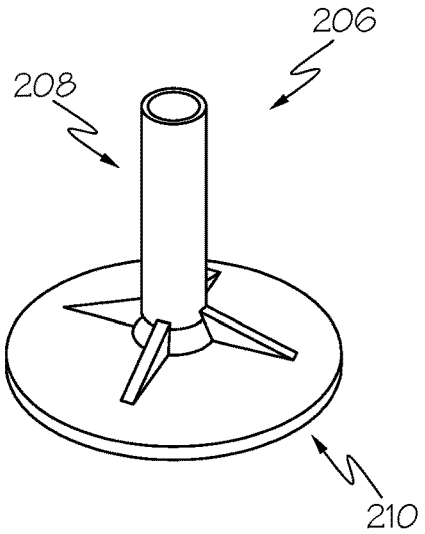
FIGS. 2A, 2B depict a flat base component of a relocatable illuminator, according to embodiments described herein.
Figure 2B:
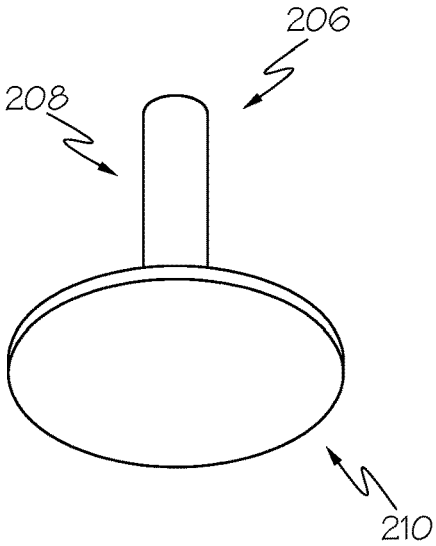

FIGS. 2A, 2B depict a flat base component 206 of a relocatable illuminator 102, according to embodiments described herein. As illustrated, the flat base component 206 may include a connection portion 208 and a post portion 210. The connection portion 208 may be coupled to the illumination component 104 and/or the power component 106. As such, the connection portion 208 may include a mechanism for securing the flat base component 206 to the illumination component 104 and/or the power component.

The post portion 210 of FIGS. 2A and 2B may include a magnet (such as a rare earth magnet) for securing to the post. As such, the post portion 210 may be shaped flat (as illustrated in FIGS. 2A and 2B) to couple with a post with a flat top. However, some embodiments may be cup shaped to couple with a post that has a convex top shape. As such, some embodiments may be configured with a rigid post portion 210 and/or a malleable post portion 210 to more fully cover the surface of the post.

Figure 3A:
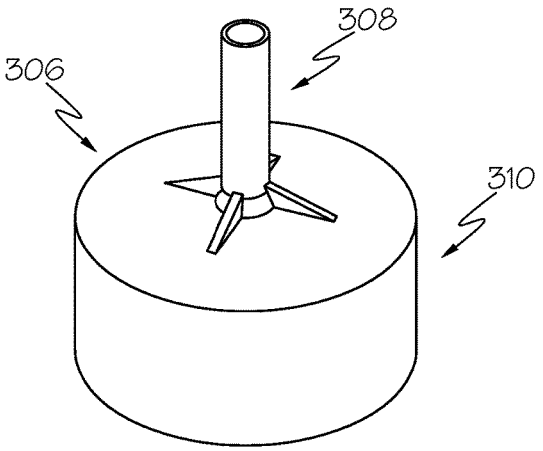
FIGS. 3A, 3B depict a cap base component of a relocatable illuminator, according to embodiments described herein.
Figure 3B:
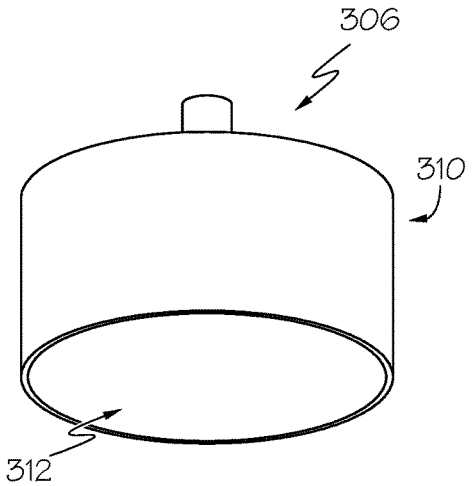

FIGS. 3A, 3B depict a cap base component 306 of a relocatable illuminator 102, according to embodiments described herein. As illustrated, the cap base component 306 may include a connection portion 308, which is similar to the connection portion 208 of FIGS. 2A and 2B. The post portion 310 is shaped to fit on top of a post. While the embodiment depicted in FIGS. 2A and 2B magnetically couples to the post, the embodiment of FIGS. 3A and 3B is configured to physically secure to the post via tension of a side section (or sidewall) of the post portion 310. Specifically, the sidewall of the post portion 310 defines an aperture 312 for receiving the post. The circumference (or diameter) of the post portion 310 is thus sized slightly larger than a circumference (or diameter) of the post to provide a snug fit with the post. Depending on the embodiment, an adhesive may be utilized for further securing the cap base component 306 to the post.

It should also be understood that while a top section of the post portion 310 is depicted in FIGS. 3A and 3B as being substantially flat, some embodiments may be concave (when viewed from inside the aperture 312) to receive a convex top portion of a post. It should also be understood that while some embodiments are rigid in nature, some embodiments may be malleable or flexible. Some of these embodiments may thus receive a securing mechanism, such as at least one zip tie, Velcro strap, snap strap, screw, and/or other securing mechanism.

Figure 4A:
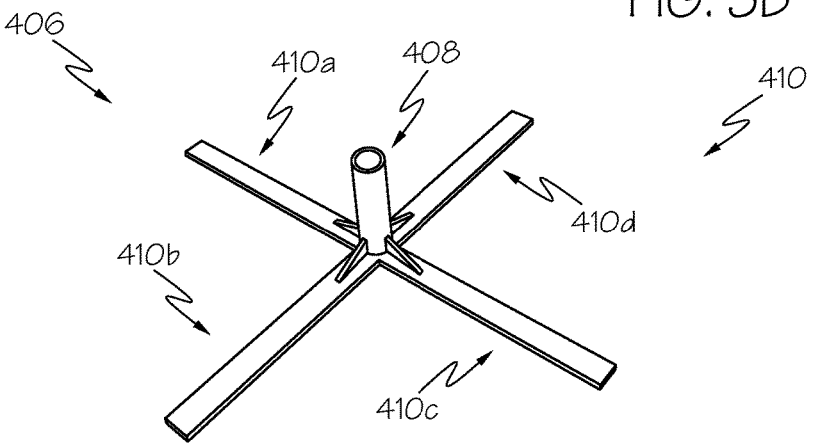
FIGS. 4A, 4B depicts a strap base component of a relocatable illuminator, according to embodiments described herein.
Figure 4B:
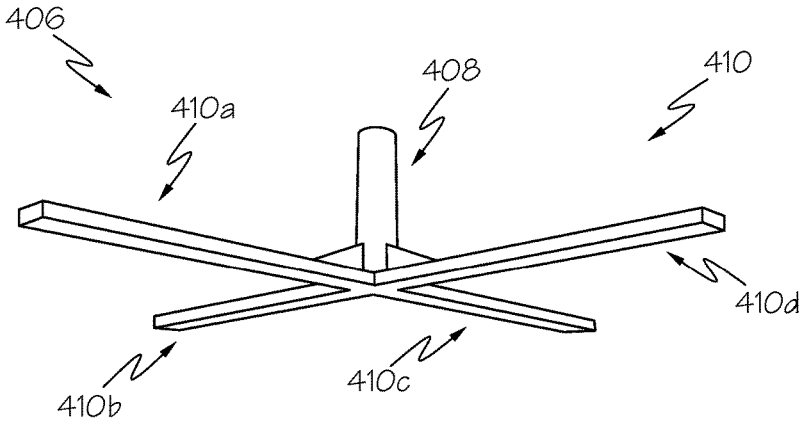

FIGS. 4A, 4B depicts a strap base component 406 of a relocatable illuminator 102, according to embodiments described herein. As illustrated, the embodiment of FIGS. 4A and 4B include a connection portion 408 similar to the embodiments described above. However, the embodiment of FIGS. 4A and 4B includes a post portion 410 that includes a plurality of straps 410*a*, 410*b*, 410*c*, and 410*d*. The straps 410 may be flexible and/or malleable to drape down a sidewall of the post. One or more securing mechanisms may be utilized to wrap around the post, thus securing the relocatable illuminator 102 to the post.

Figure 5A:
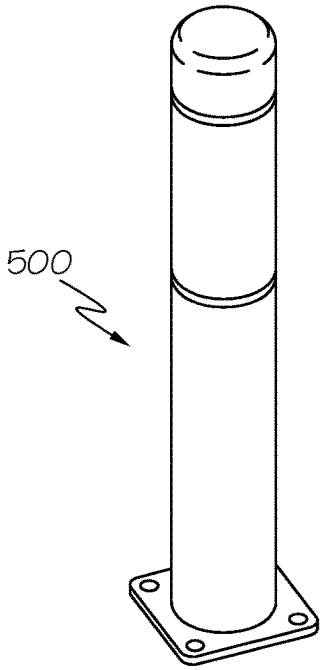
FIGS. 5A, 5B depict a relocatable illuminator coupled to a post, according to embodiments described herein.
Figure 5B:
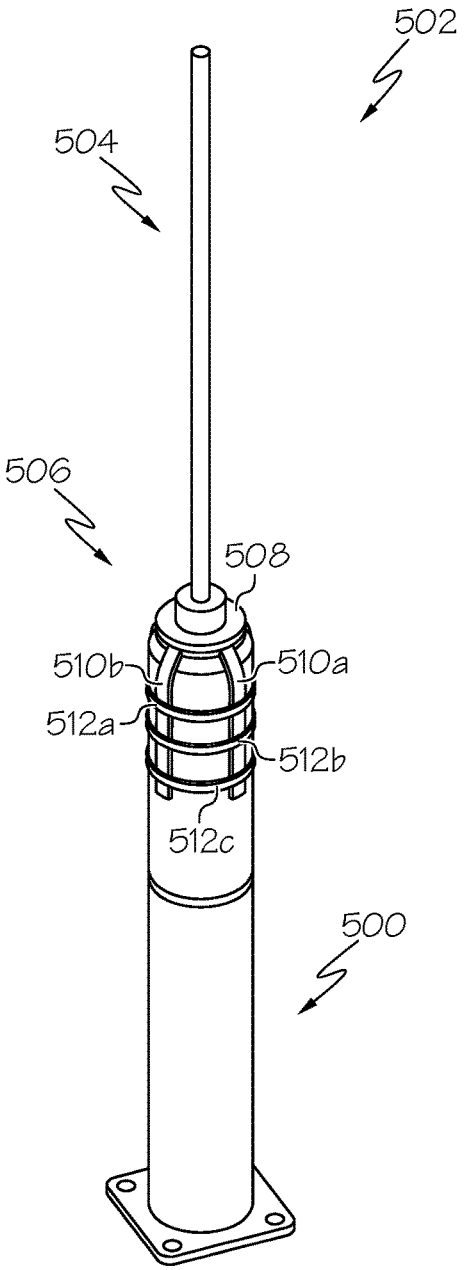

FIGS. 5A, 5B depict a relocatable illuminator 502 coupled to a post 500, according to embodiments described herein. As illustrated, a post 500 may be utilized to define a parking lot, walkway, and/or other area and may be difficult for a driver of a vehicle to see. As such, FIG. 5B depicts the relocatable illuminator 502 coupled to the post 500. The relocatable illuminator 502 may include an illumination component 504 and a base component 506. The base component 506 may include a post section 508 and one or more straps 510*a*, 510*b*, 510*c*, and 510*d*, which drape down the post 500. As also illustrated, the relocatable illuminator 502 may also include at least one securing mechanism, such as securing mechanisms 512*a*, 512*b*, 512*c* that wrap around a side portion of the post 500.

It should be understood that while FIGS. 4A, 4B, 5A, and 5B depict four straps, these are merely examples. More or fewer straps may be utilized, depending on the embodiment. Additionally, while the securing mechanisms 512 depicted in FIGS. 5A and 5B are depicted as strips of material that wrap around the post, this is also an example. Some embodiments may include screws or nails that are driven into the straps and post to secure the relocatable illuminator 502 to the post 500.

Additionally, embodiments described herein include the flat base component 206, the cap base component 306, and the strap base component 406, these are merely examples. Portions of each embodiment may be combined, depending on the embodiment. As an example, FIG. 5B depicts a flat base component with straps attached. Similarly, embodiments may include a cap base component with straps. Embodiments of the cap base component may similarly utilize a rare earth magnet (or other magnet). Other permutations are also included within the scope of this disclosure.

As illustrated above, various embodiments of relocatable locators are disclosed. These embodiments make posts and other posts more visible, as well as not requiring wired power.

While particular embodiments and aspects of the present disclosure have been illustrated and described herein, various other changes and modifications can be made without departing from the spirit and scope of the disclosure. Moreover, although various aspects have been described herein, such aspects need not be utilized in combination. Accordingly, it is therefore intended that the appended claims cover all such changes and modifications that are within the scope of the embodiments shown and described herein.

It should now be understood that embodiments disclosed herein include systems and methods associated with relocatable illuminators. It should also be understood that these embodiments are merely exemplary and are not intended to limit the scope of this disclosure.

What is claimed is:

1. A system for illuminating comprising:

a post; and a relocatable illuminator that provides a lighted indication of a location of the post and includes at least the following:

an illumination component that includes linearly displaced light emitting devices and a solar collection device coupled to the linearly displaced light emitting devices; and a base component that securely couples to the post by entirely covering a top surface of the post, wherein the base component is configured to removably secure the relocatable illuminator to the post and support the illumination component in a substantially vertical configuration, and wherein the base component includes a plurality of integrated straps that are draped over the top of the post and secured with a securing mechanism.

2. The system of claim 1, wherein the base component includes a flat base component with a rare earth magnet to secure the relocatable illuminator to the post.

3. The system of claim 1, wherein the base component includes a cap base component with a diameter that fits over a top portion of the post to secure the relocatable illuminator to the post.

4. The system of claim 1, wherein the securing mechanism includes at least one of the following: a zip tie, a Velcro strap, a snap strap, or a screw.

5. The system of claim 1, wherein the illumination component is constructed of polycarbonate.

6. The system of claim 1, wherein the relocatable illuminator includes a photovoltaic cell and a battery for providing energy to the linearly displaced light emitting devices.

7. A system for illuminating comprising:

a post; and a relocatable illuminator that includes at least the following:

an illumination component that provides a lighted indication of a location of the post and includes a light emitting device and a solar collection device coupled to the light emitting device; and a base component that securely couples to the post by covering at least a top surface of the post and at least a portion of a sidewall of the post, wherein the base component supports the illumination component in a substantially vertical configuration, wherein the base component includes a plurality of integrated straps that are draped over the top of the post and secured with a securing mechanism.

8. The system of claim 7, wherein the base component includes a flat base component portion with a rare earth magnet to removably secure the relocatable illuminator to the post.

9. The system of claim 7, wherein the base component includes a cap base component with a diameter that fits over a top portion of the post to secure the relocatable illuminator to the post.

10. The system of claim 7, wherein the securing mechanism includes at least one of the following: a zip tie, a Velcro strap, a snap strap, or a screw.

11. The system of claim 7, wherein the illumination component is constructed of polycarbonate.

12. The system of claim 7, wherein the relocatable illuminator includes a photovoltaic cell and a battery for providing energy to the light emitting device.

13. A relocatable illuminator comprising:

an illumination component that includes a plurality of light emitting devices;

a solar collection device coupled to the plurality of light emitting devices; and a base component that removably couples to a post by covering at least a portion of a top surface of the post, wherein the base component is configured to support the illumination component in a substantially vertical configuration to provide a lighted indication of a location of the post, wherein the base component includes a plurality of integrated straps that are draped over the top of the post and secured with a securing mechanism.

14. The relocatable illuminator of claim 13, wherein the base component includes a flat base component with a rare earth magnet to secure the base component to the post.

15. The relocatable illuminator of claim 13, wherein the base component includes a cap base component with a diameter that fits over a top portion of the post to secure the base component to the post.

16. The relocatable illuminator of claim 13, wherein the base component is secured to the post via a securing mechanism includes at least one of the following: a zip tie, a Velcro strap, a snap strap, or a screw.

17. The relocatable illuminator of claim 13, wherein the illumination component is constructed of polycarbonate.

* * * * *